US006875334B2

(12) United States Patent
Ostrovsky

(10) Patent No.: US 6,875,334 B2
(45) Date of Patent: Apr. 5, 2005

(54) METHOD OF ANODIZING OF MAGNESIUM AND MAGNESIUM ALLOYS AND PRODUCING CONDUCTIVE LAYERS ON AN ANODIZED SURFACE

(75) Inventor: Ilya Ostrovsky, Kibbutz Alonim (IL)

(73) Assignee: Alonim Holding Agricultural Cooperative Society Ltd., Kibbutz Alonim (IL)

( * ) Notice: Subject to any disclaimer, the term of this patent is extended or adjusted under 35 U.S.C. 154(b) by 283 days.

(21) Appl. No.: 10/179,337

(22) Filed: Jun. 26, 2002

(65) Prior Publication Data

US 2003/0000847 A1 Jan. 2, 2003

Related U.S. Application Data

(60) Provisional application No. 60/301,147, filed on Jun. 28, 2001.

(51) Int. Cl.[7] ..... C25D 9/00; C23C 22/00

(52) U.S. Cl. ..... 205/316; 205/324; 205/326; 205/332; 148/245; 148/253; 148/259; 148/260; 148/269; 148/275; 148/281

(58) Field of Search ..... 205/316, 324, 205/326, 332; 148/245, 253, 259, 260, 269, 275, 281

(56) References Cited

U.S. PATENT DOCUMENTS

| | | | |
|---|---|---|---|
| 3,216,835 | A | 11/1965 | Saubestre |
| 4,023,986 | A | 5/1977 | Kessler |
| 4,184,926 | A | 1/1980 | Kozak |
| 4,196,060 | A | 4/1980 | Patrie et al. |
| 4,247,378 | A | 1/1981 | Harris |
| 4,551,211 | A | 11/1985 | Kobayashi et al. |
| 4,620,904 | A | 11/1986 | Kozak |
| 4,978,432 | A | 12/1990 | Schmeling et al. |
| 5,141,778 | A | 8/1992 | Yarkosky et al. |
| 5,240,589 | A | 8/1993 | Bartak et al. |
| 5,264,113 | A | 11/1993 | Bartak et al. |
| 5,266,412 | A | 11/1993 | Bartak et al. |
| 5,269,838 | A | 12/1993 | Inoue et al. |
| 5,470,664 | A | 11/1995 | Bartak et al. |
| 5,792,335 | A | 8/1998 | Barton |
| 6,059,897 | A | 5/2000 | Koerner et al. |
| 6,280,598 | B1 | 8/2001 | Barton et al. |
| 6,364,544 | B1 | 4/2002 | Sasayama et al. |
| 6,379,523 | B1 | 4/2002 | Takabayashi |

*Primary Examiner*—Robert R. Koehler
(74) *Attorney, Agent, or Firm*—Mark M. Friedman

(57) ABSTRACT

A method, a composition and a method for making the composition for anodizing metal surfaces, especially magnesium surfaces is disclosed. The composition is a basic aqueous solution including hydroxylamine, phosphate anions and nonionic surfactants. A complementary method, composition and method for making the composition for rendering an anodized metal surface, especially a magnesium surface, conductive is disclosed. The composition is a basic aqueous solution including bivalent nickel, pyrophosphate anions, sodium hypophosphite and either ammonium thiocyanate or lead nitrate.

49 Claims, No Drawings

METHOD OF ANODIZING OF MAGNESIUM AND MAGNESIUM ALLOYS AND PRODUCING CONDUCTIVE LAYERS ON AN ANODIZED SURFACE

This application claims the benefit of provisional application No. 60/301,147 filed on Jun. 28, 2001.

FIELD OF THE INVENTION

The present invention is directed to the field of metal surface preparation and more particularly, to a method and a composition of anodizing magnesium and magnesium alloys and producing conductive layers on an anodized surface.

BACKGROUND OF THE INVENTION

The light weight and strength of magnesium and magnesium alloys makes products fashioned therefore highly desirable for use in manufacturing critical components of, for example, aircraft, terrestrial vehicles and electronic devices. One of the most significant disadvantages of magnesium and magnesium alloys is corrosion. Exposure to the elements causes magnesium and magnesium alloy surfaces to corrode rather quickly, corrosion that is both unesthetic and reduces strength.

There are many methods for improving the corrosion resistance of a magnesium and magnesium alloy workpiece by modifying the surface of the workpiece. It is generally accepted that the best corrosion resistance for magnesium and magnesium alloy surfaces is achieved by anodization. In anodization, a metal workpiece is used as an anode of an electrical circuit, the circuit including an electrolyte bath in which the workpiece is immersed. Depending on the properties of the current, bath temperature and the composition of the electrolyte bath, the surface of the workpiece is modified in various ways. Various solutions and additives are found in, for example: U.S. Pat. No. 4,023,986 (trihalogenated compound and a group 1b, 2, 3a, 4b, 5b, 6b and 8 metal and an alkarylamine); U.S. Pat. No. 4,184,926 (alkali metal silicate and alkali metal hydroxide solution); U.S. Pat. No. 4,551,211 (aluminate and alkali hydroxide and boron/sulfate/phenol/iodine solution); U.S. Pat. No. 4,620,904 (basic silicate and hydroxide and fluoride solution); U.S. Pat. No. 4,978,432 (basic pH with borate/sulfonate, phosphate and fluoride/chloride solution); U.S. Pat. No. 5,264,113 (basic pH with fluoride solution followed by basic with hydroxide, fluoride and silicate solution); U.S. Pat. No. 5,470,664 (neutral $NH_4F$ solution followed by basic hydroxide and fluoride/fluorosilicate and silicate solution); U.S. Pat. No. 5,792,335 (ammonia and phosphate solution with optional ammonium salts and optional peroxides); and U.S. Pat. No. 6,280,598 (various amines/ammonia and phosphate/fluoride with optional sealing agents).

Although anodization is effective in increasing corrosion resistance and the hardness of the surface, anodization is not perfect.

Anodized magnesium surface become very rough, with many pores caused by sparking during the anodization procedure. These pores trap humidity and other corrosion-inducing agents. Upon exposure to extreme conditions, humidity is trapped in the pores, leading to corrosion. The use of ammonia or amine in the solutions taught in U.S. Pat. No. 5,792,335 and U.S. Pat. No. 6,280,598 apparently reduces the extent of sparking, leading to smaller pores.

An additional disadvantage is that an anodized surface is electronically insulating. Thus anodization cannot be used in applications where an electrically conductive workpiece is desired. Applications where the strength and light weight of magnesium are desired, but require corrosion resistance and conductivity include portable communications, space exploration and naval applications.

One possible solution is an innovative silane coating described in a copending patent application by the same inventor of the present invention, described in U.S. provisional patent application No. 60/301,147. A solution including a sulfane silane, such as bis-triethoxysilylpropyl tetrasulfane is used to coat an unanodized conductive surface. The silane layer coats the surface, preventing contact with humidity, preventing corrosion. Further, since the silane layer is so thin, the break-through voltage is very low so the workpiece is effectively conductive. Despite the remarkable corrosion resistance of a surface treated using the solution, the corrosion resistance is less than that of some anodized surfaces. In a location where the silane coated surface is repeatedly rubbed or abraded, the silane layer is worn away, exposing untreated surface to the elements, leading to corrosion. Lastly, unlike anodization, the silane layer does not increase the hardness of the surface.

In the art, a number of methods for depositing a conductive layer on magnesium and magnesium alloys are known. Many methods involve the direct application of a nickel layer onto a magnesium surface. Best known is the electroless nickel method where using a multistage electroless process a nickel layer is applied to a copper layer applied to a zinc layer applied to a magnesium workpiece (shorthand: Ni/Cu/Zn/Mg sandwich). Although highly effective in producing a hard, corrosion resistant and conductive workpiece, the method is expensive and is environmentally damaging due to the extensive use of poisonous cyanide compounds.

Ingram & Glass Ltd. (Surrey, United Kingdom) provide an electroless method of applying a Ni/Zn/Mg sandwich. Although conductive and hard, a workpiece so treated corrodes rather easily. Since the nickel and zinc layers are porous, humidity penetrates to the magnesium surface and leads to galvanic corrosion.

ATOTECH (Rock Hill, S.C., USA) and Enthone-OMI (Foxborough, Mass., USA) provide the intensive etching of a magnesium surface with fluorides solutions followed by the electroless application of a conductive nickel layer on the resulting magnesium fluoride (MgF) layer. Although conductive, corrosion resistance is poor. Further, the etching steps damage the surface, especially of die-cast parts, and are thus unsuitable for high-precision workpieces. The ATOTECH method further uses highly toxic and environmentally dangerous chromates.

In addition to the above-discussed disadvantages, all the methods are suitable for application only to an entire workpiece. It is difficult, using the teachings known in the art to fashion a magnesium or magnesium alloy workpiece having a surface where selected areas are conductive whereas the other areas are not conductive.

It would be highly advantageous to have a method for treating magnesium or magnesium alloy surfaces so as to have high corrosion resistance and hard yet conductive surface. Further, it is preferable that such a treatment be selective, that is that after treatment only selected areas of a surface are conductive.

SUMMARY OF THE INVENTION

The present invention is of a method, a composition and a method for making the first composition for anodizing metal surfaces, especially magnesium surfaces. The first (anodization) composition is a basic aqueous solution including hydroxylamine, phosphate anions, nonionic surfactants and alkali metal hydroxides.

The present invention is also of a complementary method, a composition and a method for making the composition for rendering an anodized metal surface, especially an anodized magnesium surface, conductive. The second composition is a basic aqueous solution including bivalent nickel, pyrophosphate anions, sodium hypophosphite and either ammonium thiocyanate or lead nitrate.

According to the teachings of the present invention there is provided a composition useful for anodization of a magnesium or magnesium alloy surface the composition being an anodization solution of hydroxylamine, phosphate anions, nonionic surfactant and an alkali metal hydroxide in water and having a pH greater than about 8.

According to a feature of the present invention, the concentration of hydroxylamine in the anodization solution is preferably between about 0.001 and about 0.76 M, more preferably between about 0.007 and about 0.30 M, even more preferably between about 0.015 and about 0.15 M, and most preferably between about 0.015 and about 0.076 M.

According to a feature of the present invention, the concentration of phosphate anions in the anodization solution is preferably between about 0.001 and about 1.0 M.

According to a feature of the present invention, the concentration of nonionic surfactant in the anodization solution is preferably between about 20 ppm and about 1000 ppm, more preferably between about 100 ppm and about 900 ppm, even more preferably between about 150 ppm and about 700 ppm, and most preferably between about 200 ppm and about 600 ppm.

According to a further feature of the present invention the nonionic surfactant is a polyoxyalkylene ether, preferably a polyoxyethylene ether preferably chosen from a group consisting of polyoxyethylene oleyl ethers, polyoxyethylene cetyl ethers, polyoxyethylene stearyl ethers, polyoxyethylene dodecyl ethers, such as polyoxyethylene(10) oleyl ether.

According to a feature of the present invention, the pH is preferably greater than about 9, more preferably above 10 and even more preferably above 12. That said, the alkali metal hydroxide added is preferably either KOH or NaOH in a concentration of between about 0.5M and about 2M.

There is also provided according to the teachings of the present invention a method of preparing an anodization solution of the present invention as described herein above by mixing the necessary constituents. According to a feature of the present invention, the hydroxylamine is provided as substantially pure hydroxylamine or as hydroxylamine phosphate. According to a feature of the present invention the phosphate anions are provided as at least one compound selected from the group consisting of $NH_4H_2PO_4$, $(NH_4)_2HPO_4$, $NaH_2PO_4$, and $Na_2HPO_4$. According to a still further feature of the present invention both the hydroxylamine and the phosphate anions are provides as hydroxylamine phosphate.

According to a still further feature of the present invention, the pH of the anodization solution is preferably greater than about 9, more preferably above about 10 and even more preferably above about 12. The pH is preferably achieved by the addition KOH, NaOH or $NH_4OH$. That said, the alkali metal hydroxide added is preferably either KOH or NaOH in a concentration of between about 0.5M and about 2M.

There is also provided according to the teachings of the present invention a method of treating a workpiece (having a surface of magnesium, magnesium alloys, titanium, titanium alloys, beryllium, beryllium alloys, aluminum or aluminum alloys), immersing the surface in an anodizing solution, providing a cathode in the anodizing solution and passing a current between the surface and the cathode through the anodizing solution wherein the anodizing solution is substantially as described immediately hereinabove.

According to a feature of the present invention the current density at any given anodization potential can be chosen so as to be low enough so as to outside the sparking regime (generally less than about 4 A for every $dm^2$ of the surface) or high enough to be within the sparking regime (generally greater than about 4 A for every $dm^2$ of the surface).

According to one feature of the present invention (known as the high phosphate concentration regime which is exceptionally suitable for magnesium, magnesium alloys, beryllium, beryllium alloys, aluminum and aluminum alloy surfaces) the concentration of phosphate anions in the anodizing solution is between about 0.05 and about 1.0 M and during the actual anodization process when current is passed through the workpiece, the temperature of the anodization solution is maintained (by cooling) to be between about 0° C. and about 30° C.

According to another feature of the present invention (known as the low phosphate concentration regime which is exceptionally suitable for magnesium, magnesium alloys, titanium and titanium alloy surfaces) the concentration of phosphate anions in the anodizing solution is less than about 0.05 M.

According to the teachings of the present invention there is provided a composition useful for rendering an anodized magnesium or magnesium alloy conductive the composition being an aqueous nickel solution of bivalent nickel, pyrophosphate anions, sodium hypophosphite and a fourth component, the fourth component being ammonium thiocyanate or lead nitrate.

According to a feature of the present invention, the concentration of bivalent nickel in the nickel solution is preferably between about 0.0065 M and about 0.65 M, more preferably between about 0.0026 M and about 0.48 M, even more preferably between about 0.032 M and about 0.39 M, and most preferably between about 0.064 M and about 0.32 M.

According to a feature of the present invention, the concentration of pyrophosphate anions in the nickel solution is preferably between about 0.004 M and about 0.75 M, more preferably between about 0.02 M and about 0.66 M, even more preferably between about 0.07 M and about 0.56 M and most preferably between about 0.09 M and about 0.38 M.

According to a feature of the present invention, the concentration of hypophosphite anions in the nickel solution is preferably between about 0.02 M and about 1.7 M, more preferably between about 0.06 M and about 1.1 M, even more preferably between about 0.09 M and about 0.85 M and most preferably between about 0.11 M and about 0.57 M.

According to a feature of the present invention when the fourth component is ammonium thiocyanate, the concentration of the fourth component in the nickel solution is preferably between about 0.05 ppm and 1000 ppm, more preferably between about 0.1 ppm and 500 ppm, even more preferably between about 0.1 ppm and 50 ppm, and most preferably between about 0.5 ppm and 10 ppm. When lead nitrate is the fourth component, a molar equivalent amount is added.

According to a feature of the present invention, the pH of the nickel solution is preferably greater than about 7, more preferably above 8 and even more preferably between 9 and 14.

There is also provided according to the teachings of the present invention a method of preparing a nickel solution of the present invention as described hereinabove by mixing the necessary constituents. According to a feature of the present invention, the bivalent nickel is provided as $NiSO_4$ and $NiCl_2$. According to a feature of the present invention the pyrophosphate anions are provided as at least one compound selected from the group consisting of $Na_4P_2O_7$ or $K_4P_2O_7$. According to a still further feature of the present invention the hypophosphite anions are provided as sodium hypophosphite. According to a feature of the present invention, the pH appropriate for the nickel solution of the present invention is preferably attained by adding a base, preferably $NH_4OH$.

There is also provided according to the teachings of the present invention a method of treating a workpiece (having a surface of magnesium, magnesium alloys, titanium, titanium alloys, beryllium, beryllium alloys, aluminum or aluminum alloys) by anodizing the surface (preferably in a basic anodizing solution, most preferably substantially in an anodizing solution of the present invention as described hereinabove) and subsequently applying a bivalent nickel solution to at least part (not necessarily all) the anodized surface, the bivalent nickel solution preferably being substantially the bivalent nickel solution of the present invention as described immediately hereinabove. When the bivalent nickel solution of the present invention is used, the temperature of the solution is preferably between about 30° C. and about 96° C., more preferably between about 50° C. and about 95° C. and even more preferably between about 70° C. and about 90° C.

According to a feature of the present invention, subsequent to anodizing the surface but preceding contacting with the bivalent nickel solution, a mask material is applied to at least a portion of an anodized surface. A preferred mask material is MICROSHIELD® STOP-OFF LACQUER. The mask material prevents masked parts of the anodized surface from coming in contact with the bivalent nickel solution, so that only non-masked parts of the surface become conductive.

Thus, there is also provided according to the teachings of the present invention an article having an anodized surface of magnesium, magnesium alloys, titanium, titanium alloys, beryllium, beryllium alloys, aluminum and aluminum alloys where on at least a part of the anodized surface there is a conductive coating, the conductive coating made of nickel atoms so that the conductive coating conducts electricity through the anodized surface to the bulk of the article.

Hereinfurther, the term "magnesium surface" will be understood to mean surfaces of magnesium metal or of magnesium-containing alloys. Magnesium alloys include but are not limited to AM-50A, AM-60, AS-41, AZ-31, AZ-31B, AZ-61, AZ-63, AZ-80, AZ-81, AZ-91, AZ-91D, AZ-92, HK-31, HZ-32, EZ-33, M-1, QE-22, ZE-41, ZH-62, ZK-40, ZK-51, ZK-60 and ZK-61.

DETAILED DESCRIPTION OF THE INVENTION

The present invention is of a method of anodizing a magnesium surface in an anodizing solution of the present invention and also of a method of coating an anodized layer using a nickel solution of the present invention so as to produce a corrosion resistant yet conductive coating.

The principles and use of the method of the present invention may be better understood with reference to the accompanying description. Before turning to details of the present invention, it should be appreciated that the present invention provides two sets of features, each of which may be used alone, or which may be combined to provide a particularly useful method.

The first feature relates to an innovative method of anodizing magnesium surfaces. The second feature relates to a conductive coating for anodized surfaces and a method for applying the same. The surfaces can thereafter be treated with the silane solution of copending patent application by the same inventor, described herein and in U.S. provisional patent application No. 60/301,147.

Anodizing Process for Metal Surfaces, in Particular Magnesium and Magnesium Alloys The anodizing method of the present invention involves immersing a workpiece having a magnesium surface in an anodizing solution of the present invention and allowing the surface to act as an anode of an electrical circuit. Applied through the circuit is a DC (direct current) or a pulsed DC current.

As is clear to one skilled in the art, it is necessary to control the potential of current during the anodization process. If the potential is very low, no anodization occurs. In contrast, a high potential leads to excessive heating of the workpiece. Experiments show that effective anodization begins at a minimum of about 50V. Above about 500V heating of the workpiece is intense. As a guideline, a potential from about 90V to about 200V has been found to be suitable for anodization according to the method of the present invention.

Also clear to one skilled in the art is the necessity to control the current density during an anodization process. When using the solution of the present invention, it has been found that there exist two regimes of current density. When the current density is low, e.g. less than about 4 $A/dm^2$, no sparking occurs. When the current density is high, e.g. higher than about 4 $A/dm^2$, sparking is observed.

In general, when magnesium surfaces are anodized according to the methods known in the art, sparking occurs. The sparking forms large pores on the anodized surface, rendering the surface susceptible to corrosion and for some applications, unesthetic. In contrast, when the anodization of the present invention is performed using a current density in the sparking regime (greater than 4 $A/dm^2$), pores are very small. The layer is relatively thick (e.g. 20 micron after 15 minutes).

A surface treated using a current density in the non-sparking regime is thinner (e.g. 4 micron after 5 minutes) but very dense with pores even smaller than in the sparking regime. Such a surface is very corrosion resistant and suitable for use as a pretreatment for E-coating. Further, the lower current density is less wasteful of electrical power and thus economical and friendly to the environment.

Since the electrical parameters of the anodization process are dependent on many factors including the exact composition of the bath, the shape of the bath and the size and shape of the workpiece itself, the exact details of the electrical current are not generally critical to the present invention and are easily determined, without undue experimentation, by one skilled in the art performing anodization as described herein.

Composition of an Anodizing Solution of the Present Invention

An anodization solution of the present invention is an aqueous solution made up of at least the following four components: a. hydroxylamine; b. phosphate anions; c. surfactant and d. alkali metal hydroxide.

a. The anodization solution contains any amount of hydroxylamine ($H_2NOH$), but:

| | |
|---|---|
| preferably | 0.001–0.76 M; |
| more preferably | 0.007–0.30 M; |
| even more preferably | 0.015–0.15 M; |
| and most preferably | 0.015–0.076 M. |

Hydroxylamine is readily available pure or as a phosphate salt. Since the presence of phosphate is necessary in an anodizing solution of the present invention (vide infra) and since the phosphate salt of hydroxylamine is comparatively easy to transport, store and use, the phosphate salt is preferred.

b. The anodization solution contains any amount of phosphate anion, preferably added as water-soluble phosphate salt, most preferably selected from $NH_4H_2PO_4$, $(NH_4)_2HPO_4$, $NaH_2PO_4$ or $Na_2HPO_4$, but preferably between 0.001–1.0 M.

c. The anodization solution contains any amount of a nonionic surfactant, such as a polyoxyalkyl ether, preferably a polyoxyethylene ether, more preferably selected from amongst a polyoxyethylene oleyl ether, polyoxyethylene cetyl ether, polyoxyethylene stearyl ether, polyoxyethylene dodecyl ether, and most preferably polyoxyethylene(10) oleyl ether (sold commercially as Brij® 97). The amount of Brij® 97 added is preferably 20 to 1000 ppm, more preferably 100 to 900 ppm, even more preferably 150 to 700 ppm, and most preferably 200 to 600 ppm. When a surfactant other than Brij® 97 is added, an equivalent molar amount to that described above is preferred.

d. The anodization solution of the present invention is basic, preferably having a pH above 8, more preferably above 9 and even more preferably above 10. Since magnesium can corrode at basic pHs, and as is clear to one skilled in the art does not corrode at all at a pH of greater than 12, the pH of the anodization solution of the present invention is most preferably above 12. Since hydroxylamine is naturally basic while the phosphate compounds used in formulating the solution are naturally acidic, the pH of the anodization solution of the present invention is not clearly defined without the addition of further base. Thus it is necessary to add a base to control the pH of the solution and to ensure that it is of the desired value.

Although many bases may be used to ensure that the pH of the anodization solution is of the desired value, KOH or NaOH are preferred. Of the two, KOH is more preferred. Experiments have shown that the sodium and potassium ions are integrated into the anodized layers of the present invention. Although not wishing to be held to any one theory, it is believed that the presence of the sodium and potassium ions in an anodized layer of the present contribute to the exceptionally properties of the layer, especially hardness and corrosion resistance. It has been found that anodization solutions with potassium ions generally give better results. To get these results, a minimum of 0.5M alkali metal hydroxide. It has been experimentally observed that assuming that the desired pH is achieved, concentrations of greater than 2M alkali metal hydroxide are not desirable as the conductivity of the solution is reduced to the point where excessive heating of the workpiece is observed.

Phosphate Content

The exact phosphate content in an anodizing solution of the present invention influences the surface properties achieved.

High Phosphate Content Solution

A high phosphate content solution of the present invention preferably has phosphate concentration of between about 0.05 and about 1.0 M phosphate, more preferably between about 0.1 and about 0.4 M and even more preferably between about 0.1 and about 0.4 M phosphate.

When a high phosphate content solution is used, it is necessary to control the solution temperature, by cooling, during anodization. The temperature of the solution during anodization preferably does not exceed about 30° C., and more preferably does not exceed about 25° C.

When a high phosphate content solution of the present invention is used, a relatively thick (15 to 40 micron) and harder anodized layer is attained. Apart from magnesium, a high phosphate content solution of the present invention is useful for anodizing surfaces containing aluminum, beryllium and alloys. In some cases the added expense of cooling the solution renders the use of a high phosphate content unattractive.

Low Phosphate Content Solution

A low-phosphate content solution of the present invention typically has a phosphate concentration of less than 0.05 M. The produced anodized layer is relatively thin (e.g. 10 micron) and very smooth, making an attractive finish. Apart from magnesium, a low phosphate content solution is useful for anodizing surfaces containing titanium and alloys.

It has been found most convenient, for reasons of process simplicity and costs, to add phosphate as hydroxylamine phosphate. The amount of phosphate so added is sufficient for producing an effective anodized layer. It is important to note, however, that some phosphate must be present in an anodizing solution of the present invention. Inadequate results are achieved if no phosphate at all is present.

When a low phosphate content solution is used, it is not necessary to control the solution temperature during anodization. The temperature of the solution has been experimentally found to rise to temperature up to 60° C. without negatively effecting the produced layer.

Although there are similarities between the anodizing solution of the present invention and the anodizing solution taught in U.S. Pat. No. 6,280,598, the anodizing solution of the present invention is quite different.

In the solution of the present invention, hydroxylamine is used instead of ammonia or alkyl and aryl amines of U.S. Pat. No. 6,280,598. Further, whereas in U.S. Pat. No. 6,280,598 it is explicitly stated that the use of alkali hydroxide salts is not preferred in a solution of the present invention the use of alkali metal hydroxides, especially NaOH and KOH is required.

Thus, in contrast to the teachings of U.S. Pat. No. 6,280,598 where the occurrence of sparking during anodization is discouraged, when using a solution of the present invention the occurrence of sparking is one of many parameters that may be adjusted. The unique composition of the anodization solution of the present invention allows creation of an excellent anodized layer even under sparking conditions.

Further, as stated above, the addition of sodium ions and, even more so, potassium ions to the anodization solution of the present invention give anodization layers with preferable properties.

Conductive Coating for Anodized Metal Surfaces

Anodization according to the method of the present invention produces an exceptionally good anodized surface that has few very small pores, making the anodized layer of the present invention exceptionally wear and corrosion resistant. However, like other anodizing methods, the anodized layer produced is an electrical insulator.

The second feature of the present invention is a method for rendering an anodized metal surface, especially an anodized magnesium or magnesium alloy surface, conductive by applying to the anodized surface a nickel solution of the present invention. Although application of the nickel solution of the present invention can be used to treat and thus render conductive any anodized layer formed in a basic anodizing solution, the solution is exceptionally suited for use with the anodized layer of the present invention.

When applying the nickel solution to an anodized surface according to the method of the present invention, not only is the treated area rendered conductive, but the nickel containing layer conducts electricity through the anodized layer into the bulk of the workpiece. Thus the nickel solution of the present invention can be used to treat only areas of a surface. For example, a magnesium cylinder can be fashioned as a wire where the entire cylinder (sides and end) is anodized to be corrosion resistant but the two ends are also treated with a nickel solution of the present invention. The sides of the cylinder are insulated, but electrical current can flow from one end of the cylinder to the other.

The four necessary components of the nickel solution of the present invention are a. bivalent nickel cations ($Ni^{2+}$); b. pyrophosphate anions ($P_2O_7^{4-}$); c. hypophosphite anion ($PH_2O_2^-$); and d. ammonium thiocyanate ($NH_4SCN$) or lead nitrate ($PbNO_3$) in an aqueous solution.

The preferred amounts of the four components of the solution are:

| | |
|---|---|
| a. Any amount of $Ni^{2+}$ is used, for example as $NiSO_4$ or $NiCl_2$, but | |
| preferably between | 0.0065 M and 0.65 M; |
| more preferably between | 0.0026 M and 0.48 M; |
| even more preferably between | 0.032 M and 0.39 M; |
| and most preferably between | 0.064 M and 0.32 M; |
| b. Any amount of pyrophosphate is used, for example as $Na_4P_2O_7$ or $K_4P_2O_7$, but | |
| preferably between | 0.004 M and 0.75 M; |
| more preferably between | 0.02 M and 0.66 M; |
| even more preferably between | 0.07 M and 0.56 M; |
| and most preferably between | 0.09 M and 0.38 M; |
| c. Any amount of hypophosphite anion is used, for example as sodium hypophosphite or pottasium hypophosphite, but | |
| preferably between | 0.02 M and 1.7 M; |
| more preferably between | 0.06 M and 1.1 M; |
| even more preferably between | 0.09 M and 0.85 M; |
| and most preferably between | 0.11 M and 0.57 M; |
| d. Any amount of ammonium thiocyanate is used but | |
| preferably between | 0.05 ppm and 1000 ppm; |
| more preferably between | 0.1 ppm and 500 ppm; |
| even more preferably between | 0.1 ppm and 50 ppm; |
| and most preferably between | 0.5 ppm and 10 ppm. |

When lead nitrate is used in the stead of ammonium thiocyanate, a molar amount equivalent to the amount of ammonium thiocyanate described hereinabove is preferably added.

The pH of a nickel solution of the present invention is preferably above 7, more preferably above 8, and even more preferable between 9 and 14. If necessary, a base, especially $NH_4OH$, is added to adjust the pH of the nickel solution to the desired value.

The nickel solution of the present invention is applied to the surface of the workpiece at an elevated temperature between 30° C. and 96° C., more preferably between 50° C. and 95° C., even more preferably between 70° C. and 90° C., preferably for between 30 and 60 minutes. Although a nickel solution of the present invention can be applied by dipping, spraying, wiping or brushing it is clear that dipping in a heated bath is the most economical and easiest to control method of application. After removal from the nickel solution, the surface is washed with excess water.

Partially Conductive Anodized Surfaces

As stated hereinabove, it is possible to apply the nickel solution of the present invention to only selected areas of an anodized surface. Where the nickel solution is applied to an anodized surface, as described hereinabove, the anodized layer is penetrated by a nickel containing layer making a conductive channel from the anodized surface into the bulk of the workpiece. If desired the conductive layer can be applied in a complex pattern. Although there are many ways known to one skilled in the art for applying a solution such as the nickel solution of the present invention to only selected areas of a surface, it is clear that most advantageously a mask is applied (for example by printing methods) onto areas to be protected from contact with the nickel solution prior to application of the nickel solution. The nickel solution of the present invention is subsequently applied to the surface of the workpiece. After removal of the mask, the surface has conductive areas (where the nickel solution made contact with the anodized surface) and insulating areas (where the anodized surface was protected from contact with the nickel solution). Suitable materials for use as masks must adequately adhere to the anodized surface at the elevated temperatures used. MICROSHIELD STOP-OFF® Lacquer, commercially available from Structure Probe, Inc. (West Chester, Pa., USA) is one example of a suitable masking material Sulfane Silane Coating.

After anodizing and/or after treating with a nickel solution of the present invention as described hereinabove it is advantageous to treat a surface with the silane sealing solution of the present invention described fully in the copending patent application by the same inventor, described in U.S. provisional patent application No. 60/301,147.

The sealing solution of the present invention is a sulfane silane solution, preferably a bis-triethoxysilylpropyl tetrasulfane solution. Upon application to a surface, the silane effectively attaches to the treated surface including the internal surfaces of pores. The silane surface is so water-repellant that water applied to a treated surface is observed to bead and run-off of the surface. Without wishing to be held to any one theory, apparently the silane surface prevents contact with a metal surface and prevents entry of water into pores, preventing corrosion. Although it is likely that the silane layer on exposed parts of a surface that are subjected to wear or abrasion is removed, the silane remains in the pores. As is known to one skilled in the art, corrosion is often initiated by water trapped within pores on a magnesium surface.

Use of the silane solution as described herein above prevents the appearance of galvanic corrosion. It is clear that the potential difference between magnesium and nickel promotes galvanic corrosion. Application of a silane layer according to the method of the present invention is water repellent, helping prevent galvanic corrosion.

When the silane solution of the present invention is prepared it is first necessary to hydrolyze the silane. Due to the slow rate of hydrolysis in water, sulfane silanes such as bis-triethoxysilylpropyl tetrasulfane are preferably hydrolyzed in a separate step in an acidic solution. Hydrolysis can be performed, for example, in a solution composed of 5 parts silane, 4 parts water and 1 part glacial acetic acid for 3 to 4 hours. Typically, even after 4 hours the solution is cloudy, indicating that not all of the silane is in solution or hydrolyzed.

After hydrolysis, the solution containing the hydrolyzed silane is diluted with a water/organic solvent solution so that the final solution has between 70% and 100% organic solvent, more preferably between 90% and 99% organic solvent.

The organic solvent used is a solvent that is miscible with water, and is most preferably an alcohol such as methanol or ethanol, or such solvents as acetone, ethers, or ethyl acetate.

The sealing solution has a pH between 4 and 8, preferably between 5 and 7.5, and most preferably between 6 and 7. The pH is most preferably adjusted using an inorganic base, preferably NaOH, KOH, $NH_4OH$, and most preferably NaOH or $NH_4OH$.

Treatment of a surface of the present invention using a sealing solution, such as the solution described hereinabove, is preferably done by dipping, spraying, wiping or brushing. After removal from the solution, the surface is drip, blow or air-dried.

SPECIFIC SYNTHETIC EXAMPLES

Preparation of an Anodizing Solution 0.2 mole of $Na_2HPO_4.2H_2O$ were dissolved in 500 ml of water. To this solution 25 ml of 50% solution of $NH_2OH$ were added and thoroughly mixed. To this solution was added 40 g of KOH and thoroughly mixed. To this solution 0.2 g of Brij® 97 was added. Water was added to make 1 liter of an anodizing solution of the present invention, solution A.

Preparation of a Nickel Solution of the Present Invention 0.3 mole of $NiSO_4$ was dissolved in warm water, then 0.3 mol of $K_2P_2O_7$ was added and thoroughly mixed. To this solution 0.001 g of ammonium thiocyanate was added and thoroughly mixed. To the solution was added 25 g of sodium hypophosphite. Water was added in order to make 1 liter of a nickel solution of the present invention, solution B.

Preparation of a Silane Sealing Solution 5 ml of glacial acetic acid were added to 50 ml of water and thoroughly mixed. To the acid solution was added 50 ml bis-triethoxysilylpropyl tetrasulfane. The silane/acetic acid solution was stirred for three hours to allow silane hydrolyzation. After the three hours, the silane/acetic acid solution was added to a 4:1 mixture of ethanol and isopropanol to get one liter of sealing solution. The pH of the sealing solution was adjusted to approximately 6.5 by addition of a 1 M NaOH solution, solution C.

Example 1

Corrosion Resistance of Anodized Coating

Two blocks of magnesium alloy AZ91 were cleaned in an alkaline cleaning solution. The first block was coated in a prior art anodizing solution described in MIL-M-45202 Type II for 10 minutes. The second block was coated in anodizing solution number A for 10 minutes at 20° C. and 25° C. with a current density of between 2 and 4 A/dm$^2$. Both blocks were tested in 5% salt fog in accordance with ASTM-117. The first sample was heavily corroded after 110 hours. The second block had less than 1% corrosion after 330 hours.

Example 2

Corrosion Resistance and Paint Adhesion of Anodizing Coating

A block of magnesium alloy AM 50 was coated was anodized in solution A for 10 minutes at 20° C. and 25° C. with a current density of between 2 and 4 A/dm$^2$. The block was coated by E-coating and tested in salt spray/humidity cycle test VDA 621-415. The block showed results after ten rounds of U<1% at the scribe.

Example 3

Corrosion Resistance and Electrical Resistance of Nickel Coating of the Present Invention A block of magnesium alloy AZ 91 was anodized in solution A for 5 minutes at 20° C. and 25° C. with a current density of between 2 and 4 A/dm$^2$. A section of the anodized surface was masked by application of MICROSHIELD STOP-OFF® Lacquer. The block was immersed in solution B for 30 minutes. The block was dried and the mask removed. The block was immersed in solution C for 2 minutes.

The block was tested for electrical resistance in accordance with Fed. Std No 141. The electrical resistance of the unmasked area was 4000 micro Ohm. The masked area was not conductive.

I claim:

1. A method of treating a workpiece comprising:

a. providing a surface, said surface chosen from the group consisting of magnesium, magnesium alloys, titanium, titanium alloys, beryllium, beryllium alloys, aluminum and aluminum alloys;

b. immersing said surface in an anodizing solution;

c. providing a cathode in said anodizing solution; and d. passing a current between said surface and said cathode through said anodizing solution wherein said anodizing solution is substantially an aqueous solution with a pH greater than 8 and includes:

i. hydroxylamine;

ii. phosphate anions;

iii. a nonionic surfactant; and iv. an alkali metal hydroxide.

2. The method of claim 1 wherein said alkali metal hydroxide is chosen from the group consisting of NaOH and KOH.

3. The method of claim 1 wherein the concentration of said alkali metal hydroxide is between about 0.5M and about 2M.

4. The method of claim 1 wherein the concentration of hydroxylamine in said anodizing solution is between about 0.001 and about 0.76 M.

5. The method of claim 1 wherein the concentration of phosphate anions in said anodizing solution is between about 0.001 and about 1.0 M.

6. The method of claim 1 wherein the concentration of nonionic surfactant in said anodizing solution is between about 20 ppm and about 1000 ppm.

7. The method of claim 1 wherein said nonionic surfactant is a polyoxyalkylene ether.

8. The method of claim 1 wherein said anodizing solution has a pH greater than about 9.

9. The method of claim 8 wherein said anodizing solution has a pH greater than about 10.

10. The method of claim 9 wherein said anodizing solution has a pH greater than about 12.

11. The method of claim 1 wherein said current has a density greater than or equal to a sparking regime current density.

12. The method of claim 1 wherein said current has a density less than about 4 A for every dm$^2$ of said surface.

13. The method of claim 1 wherein said current has a density greater than about 4 A for every dm$^2$ of said surface.

14. The method of claim 1 further comprising:

e. during said passing a current, maintaining said anodizing solution at a temperature of between about 0° C. and about 30° C.

and wherein the concentration of phosphate anions in said anodizing solution is between about 0.05 and about 1.0 M.

15. The method of claim 14 wherein said surface is chosen from the group consisting of magnesium, magnesium alloys, beryllium, beryllium alloys, aluminum and aluminum alloys.

16. The method of claim 1 wherein the concentration of phosphate anions in said anodizing solution is less than about 0.05 M.

17. The method of claim 16 wherein said surface is chosen from the group consisting of magnesium, magnesium alloys, titanium and titanium alloys.

18. A composition useful for anodization of a magnesium or magnesium alloy surface comprising:

a. hydroxylamine;

b. phosphate anions;

c. nonionic surfactant;

d. alkali metal hydroxide; and e. water wherein a pH of the composition is greater than about 8.

19. The composition of claim 18 wherein a concentration of said hydroxylamine is between about 0.001 and about 0.76 M.

20. The composition of claim 19 wherein a concentration of said hydroxylamine is between about 0.007 and about 0.30 M.

21. The composition of claim 20 wherein a concentration of said hydroxylamine is between about 0.015 and about 0.15 M.

22. The composition of claim 21 wherein a concentration of said hydroxylamine is between about 0.0 15 and about 0.076 M.

23. The composition of claim 18 wherein a concentration said phosphate anions is between about 0.001 and about 1.0 M.

24. The composition of claim 18 wherein a concentration of said nonionic surfactant is between about 20 ppm and about 1000 ppm.

25. The composition of claim 24 wherein a concentration of said nonionic surfactant is between about 100 ppm and about 900 ppm.

26. The composition of claim 25 wherein a concentration of said nonionic surfactant is between about 150 ppm and about 700 ppm.

27. The composition of claim 26 wherein a concentration of said nonionic surfactant is between about 200 ppm and about 600 ppm.

28. The composition of claim 18 wherein said nonionic surfactant is a polyoxyalkylene ether.

29. The composition of claim 28 wherein said polyoxyalkylene is a polyoxyethylene ether.

30. The composition of claim 18 wherein said nonionic surfactant is chosen from a group consisting of polyoxyethylene oleyl ethers, polyoxyethylene cetyl ethers, polyoxyethylene stearyl ethers, polyoxyethylene dodecyl ethers.

31. The composition of claim 18 wherein said nonionic surfactant is polyoxyethylene(10) oleyl ether.

32. The composition of claim 18 wherein said alkali metal hydroxide is chosen from the group consisting of NaOH and KOH.

33. The composition of claim 18 wherein a concentration of said alkali metal hydroxide is between about 0.5M and about 2M.

34. The composition of claim 18 wherein said pH is greater than about 9.

35. The composition of claim 34 wherein said pH is greater than about 10.

36. The composition of claim 35 wherein said pH is greater than about 12.

37. A method for the preparation of a solution useful for the treating of a magnesium or magnesium alloy surface comprising:

a. providing hydroxylamine;

b. providing phosphate anions;

c. providing a nonionic surfactant;

d. mixing said hydroxylamine, said phosphate anions and said nonionic surfactant with water to make a solution; and e. adjusting a pH of said solution so as to be greater than about 8.

38. The method of claim 37 wherein enough hydroxylamine is provided so that a concentration of hydroxylamine in the solution is between about 0.001 and about 0.76 M.

39. The method of claim 37 wherein said hydroxylamine is provided as at least one compound selected from the group consisting of substantially pure hydroxylaniine and hydroxylamine phosphate.

40. The method of claim 37 wherein enough phosphate anions are provided so that a concentration of hydroxylamine in the solution is between about 0.001 and about 1.0 M.

41. The method of claim 37 wherein said phosphate anions are provided as at least one compound selected from the group consisting of $NH_4H_2PO_4$, $(NH_4)_2HPO_4$, $NaH_2PO_4$, and $Na_2HPO_4$.

42. The method of claim 37 wherein said hydroxylamine and said phosphate anions are provided as hydroxylamine phosphate.

43. The method of claim 37 wherein enough nonionic surfactant is provided so that a concentration of nonionic surfactant in the solution is between about 20 ppm and about 1000 ppm.

44. The method of claim 37 wherein said nonionic surfactant is a polyoxyalkylene ether.

45. The method of claim 37 wherein said pH is adjusted to be greater than about 9.

46. The method of claim 45 wherein said pH is adjusted to be greater than about 10.

47. The method of claim 46 wherein said pH is adjusted to be greater than about 12.

48. The method of claim 47 wherein said pH is adjusted by adding NaOH.

49. The method of claim 48 wherein said pH is adjusted by adding KOH.

* * * * *